United States Patent [19]

Petrovich

[11] Patent Number: 4,720,030

[45] Date of Patent: Jan. 19, 1988

[54] MULTIPURPOSE BAYONET SYSTEM

[76] Inventor: Paul A. Petrovich, 11269 Judd Rd., Fowlerville, Mich. 48836

[21] Appl. No.: 8,998

[22] Filed: Jan. 30, 1987

[51] Int. Cl.[4] ..... B26B 29/02

[52] U.S. Cl. ..... 224/232; 30/151; 30/142; 7/129

[58] Field of Search ..... 224/232, 904, 242, 252, 224/253, 251, 914; 30/151, 153, 164, 155, 146, 142, 143; 7/129, 131, 132, 134, 158

[56] References Cited

U.S. PATENT DOCUMENTS

| | | | |
|---|---|---|---|
| 580,235 | 4/1897 | Strum | 7/129 X |
| 614,537 | 11/1898 | Dahlquist et al. | 7/129 X |
| 922,322 | 5/1909 | O'Malley | 7/129 X |
| 1,388,014 | 8/1921 | Aiguier | 30/153 X |
| 1,935,812 | 11/1933 | Moody | 30/155 X |
| 2,083,406 | 6/1937 | Schlemper | 30/155 X |
| 2,105,239 | 1/1938 | Bachtold | 224/232 X |
| 2,717,442 | 9/1955 | Smith | 224/232 X |
| 2,721,340 | 10/1955 | Shultz | 30/151 X |
| 2,906,021 | 9/1959 | Cromoga | 30/155 X |
| 2,924,879 | 2/1960 | Kraus, Jr. | 30/151 |
| 3,581,326 | 6/1971 | Hayes | 224/232 X |
| 3,842,458 | 10/1974 | Bauer | 7/158 X |
| 4,496,088 | 1/1985 | Tuthill | 224/232 X |
| 4,558,516 | 12/1985 | Collins | 224/232 X |

FOREIGN PATENT DOCUMENTS

| | | | |
|---|---|---|---|
| 70502 | 5/1946 | Norway | 224/232 |

*Primary Examiner*—Henry J. Recla
*Assistant Examiner*—Robert Petrik

[57] ABSTRACT

A multi purpose bayonet including a combat knife and scabbard is disclosed. The system can be used to sever wire and the like using one hand.

5 Claims, 6 Drawing Figures

MULTIPURPOSE BAYONET SYSTEM

GOVERNMENT INTEREST

The invention described herein may be manufactured, used, and licensed by or for the Government for governmental purposes without payment to me of any royalty thereon.

SUMMARY OF INVENTION

In one aspect of this invention relates to conventional military weaponry. In a further aspect this invention relates to the bayonet and related equipment normally carried by soldiers for use in close combat situations.

The bayonet is a dagger-like weapon attachable to the muzzel of a firearm for use in close-in fighting has a long history and has been a standard item of gear for foot soldiers for more than a century. The bayonet comprises essentially a knife which can be carried in a scabbard by the infantryman and attached to small arms, such as rifles when needed for close-in combat.

The length and blade configurations employed have varied over time and with the country's Army. Examples include knifes which resemble small swords and three bladed needle type structures.

Most of the prior art bayonet assemblies and structures have only a limited number of uses in that they function primarily as knife or bayonet and are not adaptable to cope with many of the situations which present themselves to todays foot soldier. Therefore, certain obstacles common to battlefield conditions are not ameable to solutions using the conventional bayonet structures. Since the transportation and distribution of a number of specialized tools is impractical in combat situations, it would be desirable to equip the soldiers with a bayonet system which can perform many of the most common functions necessary to overcome the obstacles encountered by the normal foot soldier in standard battle conditions.

In addition to performing as a bayonet and a knife, the bayonet system should function as an insulated wire cutter suitable for cutting or severing standard type barbed-wire which may be electrified with a high voltage electrical current. The knife portion of the system can also be separated to allow sawing of small items and opening of crates and the like. One present construction has a bayonet with a slotted opening in the blade which mates with a part on the scabbard to form a wire cutter. This construction requires assembly which would be time consuming under normal conditions and would be extremely difficult in the darkness and stress of a battlefield. Also, because of the construction the wire cutters have the handles widely spaced when assembled so that it requires two hands to operate. Two handed operation implies that a soldier must have a substantial portion of his body off the ground and exposed to hostile fire when trying to cut a wire suspended in the air. It would be preferable for the wire cutters to be operable with only one hand to minimize the amount of the soldiers body which must be exposed. Also having a pre-assembled system saves time and avoids the possibility of an improper assembly.

A multi-purpose bayonet system meeting the essential characteristics described above is found in the present invention. The system includes a combat knife having a handle adapted to be griped by a human hand. Complimentary means will be attached to the barrel of the gun or other small arm suitable for attaching the handle portion of the knife to the barrel with the knife extending outward from the barrel. A combat knife according to this invention comprises a blade extending outward from the handle, the knife blade being adapted for cutting and piercing. The blade can be of various shapes and lengths with one or both sides sharpened. A hilt disposed between the handle and the blade prevents the users hand from slipping off the handle when the knife is used.

A scabbard is provided with the system having a first scabbard member formed as a hollow elongated body with a cavity opening at the one end of the scabbard member. The cavity is adapted to receive and enclose the knife blade portion of the combat knife securely and safely within the cavity and allow the rapid removal of the knife blade for use. A fixed metal cutting jaw is rigidly attached to the end of the scabbard opposite of the opening of the cavity and extends longitudely outward from the end of the scabbard. The fixed metal cutting jaw is formed with a cutting edge extending longitudely along the center line of the scabbard and pivot pin mounted on one side of the fixed jaw extending transversely from the face of the fixed jaw. A movable jaw having a second cutting edge complimentary to the cutting edge of the first fixed jaw is positioned so that it can be rotated from an open position into a closed cutting position, where the cutting jaws are engaged.

An intermediate portion of the movable jaw is offset to one side of the fixed jaw and extends diagonally across the fixed jaw. The intermediate portion is located on the same side of the fixed jaw as the pivot pin and is journaled on the pivot pin allowing rotation of the movable jaw between the open and close positions.

A handle extends from the intermediate portion of the movable jaw opposite the second cutting edge coaxially along one edge of the scabbard with a free end located near the open end of the scabbard. A clamping means is provided to hold the handle close to the scabbard's edge when the jaws are closed for storage and carrying.

An attachment means is fastened to the scabbard for consistency for attaching the scabbard to a soldier's belt, pack or other equipment allowing the multi-purpose bayonet system to be quickly and easily transported.

BRIEF DESCRIPTION OF THE INVENTION

A further understanding maybe had by referring to the accompanying drawing in which.

DETAILED DESCRIPTION OF THE PREFERRED EMBODIMENTS

Figure 1:
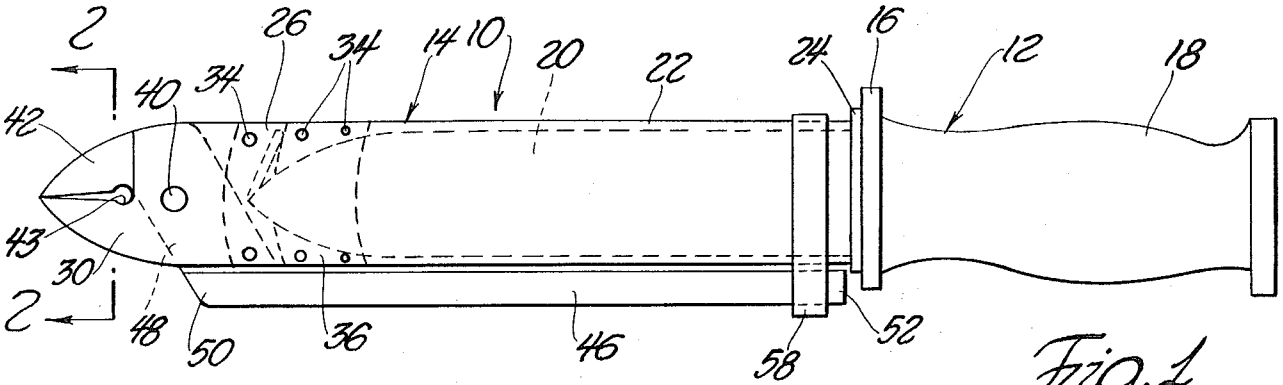
FIG. 1 is a side view of a bayonet system in accordance with this invention with the combat knife located in the scabbard.

Turning to the drawing where in like numerals refer to like parts and initially to FIG. 1, a bayonet system according to this invention is shown with a combat knife designated generally 12 mounted within a scabbard 14. Hilt 16 of the combat knife 12 is firmly abutting the open end of the scabbard. The exact structure of the combat knife 12 is not critical in the present invention. The knife will generally comprise a handle 18 suitable for being gripped by the normal sized infantry soldier in one hand for use as a knife for cutting, piercing, or hand-to-hand combat and has the hilt 16 disposed between the handle and the blade 20 to prevent the soldier's hand from slipping off the handle unto the blade when the knife is in use. Blade 20 as shown is shaped essentially as a pointed short sword type structure of symmetrical design. The blade 20 could take many shapes other than that shown, including a modified spear design with a clipped false edge.

The blade length can be chosen to conform to good infantry practice a blade on the order of 7–8 inches in length and designed to extend a substantial percentage of its total length past the muzzel of a rifle when mounted being most common. One variation might include a serrated edge near the rear portion of one side of the blade to allow its use as a saw for cutting thick ropes, small trees and light metal.

The scabbard 14 provides the second part of the bayonet combination which is shown in FIG. 1. The scabbard 14 has a main body portion 22 which is formed as a hollow chamber adapted to form a scabbard for a knife blade with a flange 24 located at the end of the scabbard for consistency having an opening suitable for receiving the knife blade. The scabbard 14 is formed as a single piece with a thick solid portion 26 located at the end of the body portion 20 opposite the opening. The scabbard 14 has an attachment means or associated carrying structure discussed hereinafter with respect to FIGS. 5 and 6. The attachment means will be suitable for use with the standard GI belt and in conformance with service specifications for items to be carried. The attachment means allows the scabbard to be attached to the utility belt commonly worn by foot soldiers or attached to other parts of the GI gear to allow it to be carried without interference to the soldier's movement and in maintaining a knife firmly within the scabbard.

In general the scabbard 14 will be formed of impact resistant, non-electrically conductive materials. One example is the plastic material available under the trade name "Cardith" which is a good insulator and impact resistant. Other materials would include fiber-filled or reinforced resins such as urethanes, polycarbonates, or nylons.

The scabbard 14 has a fixed metal cutting jaw designated generally as 30 attached to the end of the scabbard opposite the opening. The metal cutting jaw 30 has a thick body portion which is normally the same shape and width as the remainder of the scabbard and is attached to the scabbard by means of a plurality of rivits 34 which mount the fixed jaw permanently to the scabbard. As shown a reinforcement portion 36 is also attached to the scabbard to provide additional rigidity to the scabbard and the cutting mechanism. The fixed metal cutting jaw 30 has a cutting surface 38 which is formed so as to extend along the center longitudinal axis of the scabbard 14. The cutting edge cross section is shown in greater detail in FIG. 2 and can be any normal shaped wire or metal cutting type configuration. As shown the jaws are rounded on one side to a blunt cutting edge located near one face of the jaws.

Figure 4:
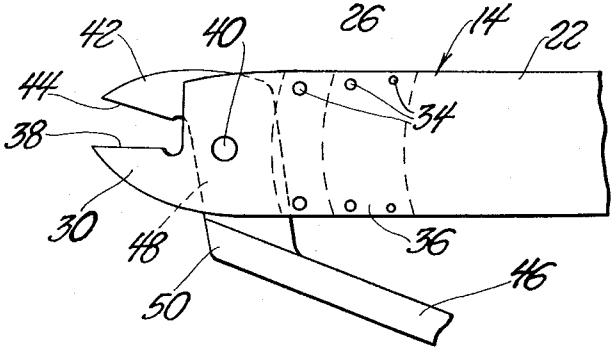
FIG. 4 is a side view of FIG. 1 with the combat knife removed and the cutting jaws in an open position.

The fixed jaw 30 has a pivot pin 40 rigidly mounted near the longitudinal axis of the jaw and body which extends outwardly from the face of the fixed jaw. The pivot pin 40 extends outward and is suitable for being attached to a second member to form a cutting unit. The fixed jaw 30 is designed to mate with a rotatable jaw 42 shown in a closed position in FIG. 1 and in open position in FIG. 4 to allow cutting of wire and small metal sections. As shown the jaws 30, 42 can be formed with a small semi-circular aperature 43 so that they form a wire-stripping aperature when in the closed position. The particular wire cutting configuration is not a part of this invention and a further description is omitted in the interest of brevity.

Figure 2:
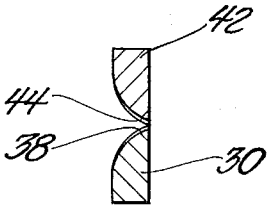
FIG. 2 is a sectional view taken of the cutting jaws of FIG. 1 along the line 2—2.
Figure 3:
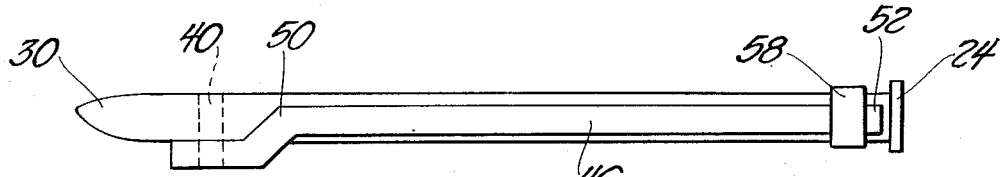
FIG. 3 is a bottom view of the scabbard of FIG. 1 with a combat knife removed.

The rotatable jaw 42 is formed with a cutting edge 44 shown in cross section in FIG. 2 which when closed will sever wire or light metal. The rotatable jaw 42 can be rotated between a open and closed position by means of a handle 46 which extends coaxially with the longitudinal axis of the scabbard 14 with the end of the handle located near the end of the scabbard. The handle 46 extends the length of the scabbard and provides additional leverage to provide the force necessary to sever wire or light metal cleanly and easily without the need to impose substantial pressure on the handle. As shown, the handle is located relatively close to the scabbard and can be operated with one hand by the normal GI in that the wire cutters can be operated with one hand and an object being cut can be held with the other hand provided there is no danger of electrocution. One handed operation is of benefit as discussed before in that it allows the soldier to use the wire cutter with minimum exposure of his body. Also, one handed operation allows the soldier to cut bands or wire with one hand while holding his weapon in a ready position.

The rotatable jaw 42 and handle 46 are connected by an intermediate portion 48 which extends diagonally across the scabbard 14 from the attachment end 50 of the handle to the rotatable jaw 42. The intermediate portion 48 is journeled on pin 40 to allow free rotation of the rotatable jaw 44 when the free end 52 of the handle is moved towards or away from the metal scabbard.

The free end 56 of the handle has a clamping means 58 associated therewith to hold the handle close to the scabbard when the cutters are not in use. In its simplest embodiment, the clamping means 58 would be an elastomeric band molded into or affixed to the scabbard and looped about the handle 46. A rubber coated spring clamp of spring metal could also be used with the tension of the metal spring used to hold the handle in position.

Figure 5:
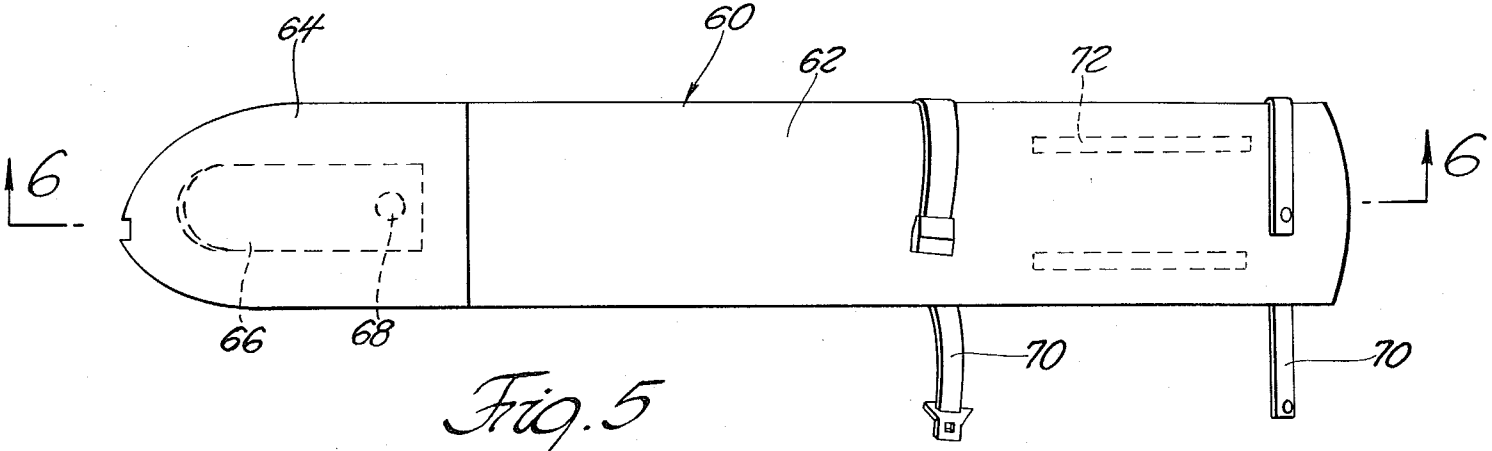
FIG. 5 is a side view of a fabric carrying device for use with the scabbard.
Figure 6:
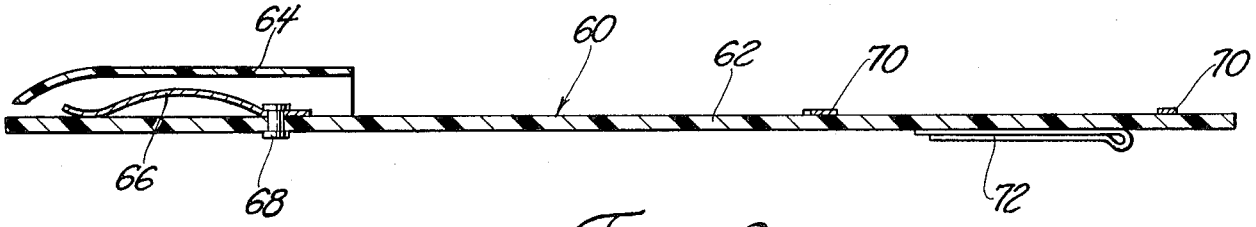
FIG. 6 is a bottom view of the carrying device of FIG. 5.

FIGS. 5 and 6 show a carrying board 60 for use with the scabbard 14 comprising a generally planer portion 62 formed of an impact resistant material or cloth. The carrying board 60 has a holder 64 formed on one end which receives the metal cutting jaws 30, 42 of the scabbard 14 to protect and hold the jaws. A spring 66 is fastened within the cavity of the holder 64 and is held in position by a rivit 68. As shown, the carrying board has a pair of straps 70 located on the end of the board to opposite the holder 64 which can be fastened around the scabbard 14 to hold it in position. The ends of straps 70 can be fastened by snaps, buckles, "Velcro" and the like.

The attachment clips 72 is fastened to the surface of the board 60 opposite the holder 64 the clips are adapted to be attached to the web belt normally worn by soldiers. The exact construction of the attachment means is not critical provided it will firmly attach the board and scabbard to the soldier's belt.

I wish it to be understood that I do not desire to be limited to the exact details of construction shown and described for obvious modifications will occur to a person skilled in the art, without departing from the spirit and scope of the appended claims.

I claim:

1. A scabbard suitable for storing a bayonet which can also perform other tasks, the scabbard including: a first scabbard member formed as a hollow elonged body with a longitudinally extending cavity forming a opening at one end of the scabbard member the cavity being adapted to receive and enclose a blade portion of the bayonet securely within the cavity but allowing rapid removal; a fixed metal cutting jaw rigidly attached to one end of the elongated body opposite the opening of the cavity and extending outward from the end of the body, the fixed metal cutting jaw being formed with a cutting edge extending longitudinally along the center line of the body; a pivot pin mounted on one side of the fixed jaw extending transversely from the face of the fixed jaw; a movable jaw attached to the pivot pin, the movable jaw having a second cutting edge which is complimentary to the cutting edge of the fixed jaw so that the movable jaw can be rotated from an open position to a closed cutting position with the cutting jaws engaged; a handle extending from the movable jaw, the handle having a free end which is located near the open end of the scabbard and extending coaxially along one side of the scabbard; an intermediate portion which connects the other end of the handle to the rotatable jaw, the intermediate portion being offset to one side of the fixed jaw and extending diagonally across the same side of the fixed jaw as the pivot pin, the intermediate portion being journeled to the pivot pin; and a clamping means attached to the free end of the body to hold the handle close to the scabbard's edge when the jaws are closed for storage.

2. The scabbard of claim 1 further including a carrying board having a planer surface with a holder formed at one end to receive and protect the metal cutting jaws when the scabbard is in place, the planer surface having fastening means at the end of the plane opposite the older to secure the scabbard on the carrying board, and attachment means provided on the planer surface to attach the assembly to a soldier's equipment.

3. A multi-purpose bayonet system suitable to perform a number of tasks, the system includes: a combat knife having a handle adapted to be gripped by human hand, a knife blade extending outward from the handle, the knife blade being adapted for cutting and stabbing; a first scabbard member formed as a hollow elonged body with a longitudinally extending cavity forming a opening at one end of the scabbard member the cavity being adapted to receive and enclose the knife blade securely within the cavity but allowing the rapid removal of the knife blade for use; a fixed metal cutting jaw rigidly attached at one end of the body opposite the opening of the cavity and extending longitudely outward from the end of the scabbard, the metal cutting jaw is formed with a cutting edge formed on the metal jaw which extends longitudely along the center line of the body; a pivot pin mounted on one side of the fixed jaw extending transversely to the face of the fix jaw; a movable jaw journaled on the pivot pin, the movable jaw having a second cutting edge which is complimentary to the cutting edge of the fixed jaw so that the movable jaw can be rotated from an open position to a closed cutting position with the cutting jaws engaged; a handle extending from the movable jaw, said handle having a first free end which is located near the open end of the scabbard and extending along the scabbard coaxially along one side of the scabbard; an intermediate portion which connects the end of the handle to the rotatable jaw, the intermediate portion being offset to one side of the fixed jaw and extending diagonally across the fixed jaw on the same side of the fixed jaw as the pivot pin, the intermediate portion being journeled to the pivot pin; and a clamping means attached to the free end of the handle opposite the intermediate portion to hold the handle close to the scabbard's edge when the jaws are closed for storage.

4. The scabbard of claim 3 further including a carrying board having a planer surface with a holder formed at one end to receive and protect the metal cutting jaws when the scabbard is in place, the planer surface having fastening means at the end of the plane opposite the older to secure the scabbard on the carrying board, and attachment means provided on the planer surface to attach the assembly to a soldier's equipment.

5. A multi-purpose bayonet system suitable to perform a number of tasks, the system includes: a combat knife having a handle adapted to be gripped by human hand, a knife blade extending outward from the handle, the knife blade being adapted for cutting and stabbing; a first scabbard member formed as a hollow elonged body with a longitudinally extending cavity forming a opening at one end of the scabbard member the cavity being adapted to receive and enclose the knife blade securely within the cavity but allowing the rapid removal of the knife blade for use; a fixed metal cutting jaw rigidly attached at one end of the body opposite the opening of the cavity and extending longitudely outward from the end of the scabbard, metal cutting jaw is formed with a cutting edge formed on the metal jaw which extends longitudely along the center line of the body; a pivot pin mounted on one side of the fixed jaw extending transversely to the face of the fix jaw; a movable jaw journaled on the pivot pin, the movable jaw having a second cutting edge which is complimentary to the cutting edge of the fixed jaw so that the movable jaw can be rotated from an open position to a closed cutting position with the cutting jaws engaged; a handle extending from the movable jaw, said handle having a first free end which is located near the open end of the scabbard and extending along the scabbard coaxially along one side of the scabbard; an intermediate portion which connects the other end of the handle opposite the first end to the rotatable jaw, the intermediate portion being offset to one side of the fixed jaw and extending diagonally across the fixed jaw on the same side of the fixed jaw as the pivot pin, the intermediate portion being journeled to the pivot pin; a clamping means attached to the free end of the handle opposite the intermediate portion to hold the handle close to the scabbard's edge when the jaws are closed for storage; a carrying board for carrying scabbard and knife having a planer surface with a holder formed at one end to receive and protect the metal cutting jaws when the scabbard is in place, the planer surface has fastening means at the end of the plane opposite the holder to secure the scabbard, and attachment means are provided on the planer surface to attach the assembly to a soldier's equipment.

* * * * *